United States Patent [19]

Gulya

[11] Patent Number: 4,737,241

[45] Date of Patent: Apr. 12, 1988

[54] METHOD OF MAKING A PAPERMAKER'S FELT

[75] Inventor: Thomas G. Gulya, Appleton, Wis.

[73] Assignee: Appleton Mills, Appleton, Wis.

[21] Appl. No.: 17,227

[22] Filed: Feb. 20, 1987

[51] Int. Cl.[4] ..... D21F 7/10; D21F 3/00

[52] U.S. Cl. ..... 162/199; 28/141; 139/383 A; 162/200; 162/273; 162/358; 162/DIG. 1; 428/234; 428/300

[58] Field of Search ..... 162/199, DIG. 1, 348, 162/358, 273; 28/141, 142, 110; 139/383 A, 383 AA; 156/148, 159, 258, 304.1, 304.3-304.7; 428/300, 223, 234

[56] References Cited

U.S. PATENT DOCUMENTS

| | | | |
|---|---|---|---|
| 3,815,645 | 6/1974 | Cordornlu | 139/383 |
| 4,095,622 | 6/1978 | MacBean | 139/383 |
| 4,123,022 | 10/1978 | Dutt et al. | 245/10 |
| 4,401,137 | 8/1983 | Cannon | 139/383 |
| 4,425,392 | 1/1984 | Oikawa | 428/90 |
| 4,601,785 | 7/1986 | Lilja et l. | 162/199 |

*Primary Examiner*—S. Leon Bashore
*Assistant Examiner*—K. M. Hastings
*Attorney, Agent, or Firm*—Andrus, Sceales, Starke & Sawall

[57] ABSTRACT

A method of making a papermaker's felt which includes the steps of forming a pin seam fabric having interdigitated loops at the ends of the fabric joined by a pin. A batt of fibrous material is needled into at least one face of the fabric and across the pin seam joint. When the felt is to be installed on the papermaking machine, the pin is removed and the felt is bent back on itself at the joint to bring the portions of the batt adjacent the joint into contiguous or contacting relation and cause the loops to separate. The batt is then cut along a line extending through the separated loops to provide a flat or opened felt which can then be installed on the papermaking machine. After installation, the loops are interdigitated and the pin is reinserted through the loops to provide the endless felt construction.

4 Claims, 1 Drawing Sheet

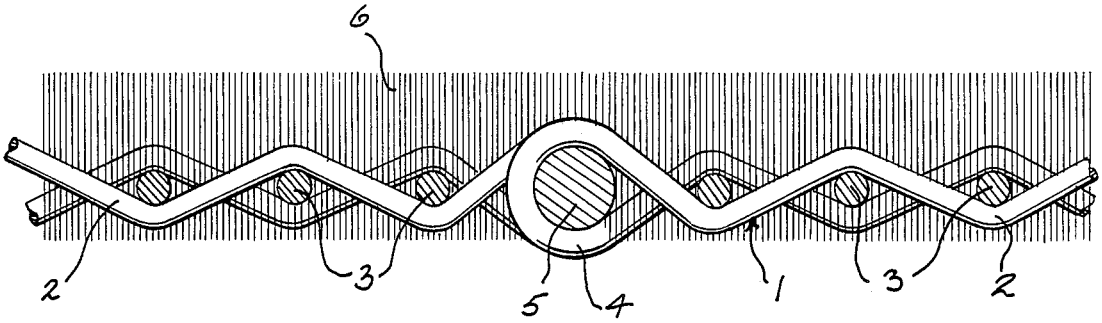
FIG. 1
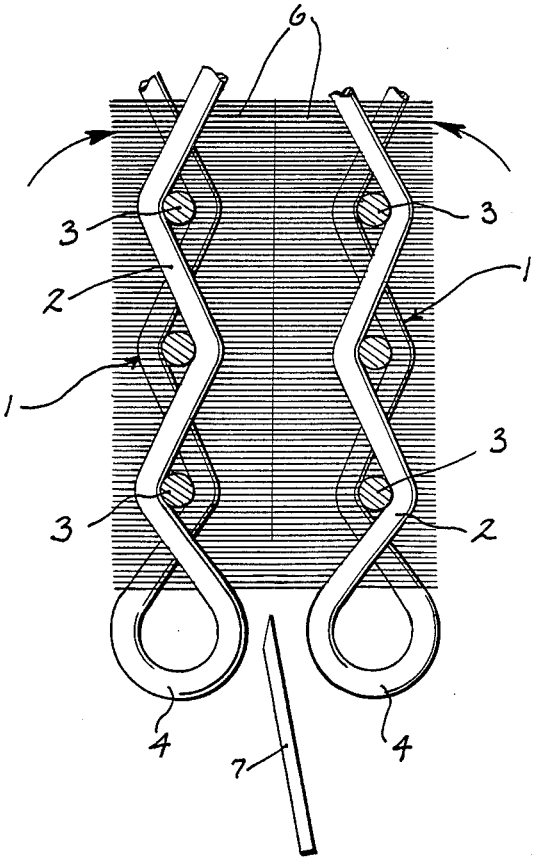
FIG. 2
FIG. 3
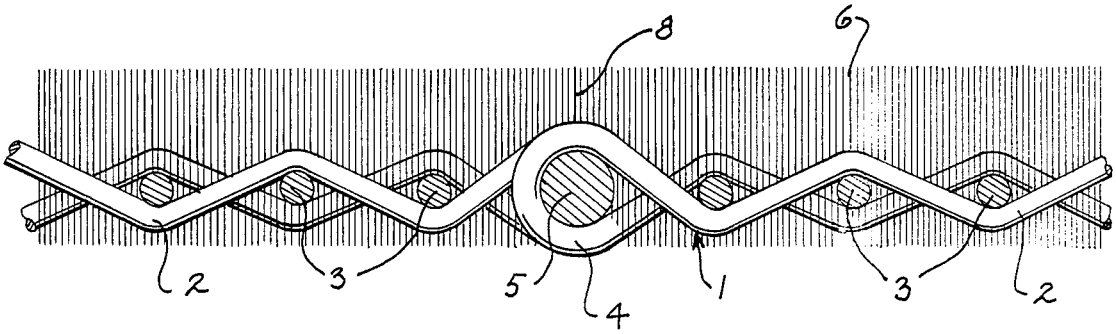

METHOD OF MAKING A PAPERMAKER'S FELT

BACKGROUND OF THE INVENTION

Pin seam fabrics for use on papermaking machines are composed of a woven base and the ends of the base are provided with interdigitated loops that are connected by a removable pin or pintle. The base fabric can either be woven in endless form, as disclosed in U.S. Pat. No. 3,815,645, or alternately can be woven in flat form, in which case loops are attached to the free ends of the fabric, in a manner such as disclosed in U.S. Pat. Nos. 4,123,022 and 4,401,137.

A pin seam fabric has distinct advantages in that it can readily be installed and removed from the papermaking machine by insertion and removal of the pin from the interdigitated loops at the ends of the fabric. However, in the past, pin seam fabrics have not been successfully employed as papermaker felts in the press section of the papermaking machine. It is essential that a felt have uniform water drainage characteristics and density throughout its length in order to obtain uniform water extraction from the paper web, as well as to prevent marring or marking of the paper. As pin seam fabrics have generally been produced in flat form with loops subsequently attached or interwoven into the free ends, the density adjacent the ends is normally greater, due to the interweaving of the loops, than the density of the remainder of the fabric. If used as a felt, this variation in density can produce non-uniform water extraction characteristics, and the added fibers in the area of the pin seam joint can cause marring or non-uniform texture for the paper web.

It is also recognized that it is desirable to construct a papermaker's felt with an outer batt of fibrous material which is needled to the base fabric. The batt serves to engage and protect the paper sheet as it passes through the nip, while the base fabric is designed to receive extracted water from the paper sheet and carry it away from the press nip. The batt is attached to the base fabric on a needling machine, in which the base fabric, in endless form, is advanced through the needling area. However, a needled batt is not normally used with a pin seam base fabric, because the batt, through needling, would be intertwined with the pin seam joint and would prevent the joint from being opened so that the fabric could be installed on the papermaking machine.

U.S. Pat. No. 4,601,785 discloses a pin seam base fabric having a needled batt which can be used as a felt in the press section of a papermaking machine. According to the aforementioned patent, the base fabric is produced in flat form and loops are provided in the ends to provide a pin seam fabric. A batt is then needled into at least one surface of the fabric and after needling, the batt is cut at a location offset from the pin seam joint and the portion of the batt extending across the joint is loosened from the base fabric to provide a flap. The pin is removed from the pin seam joint, and after installation of the felt on the papermaking machine, the pin is reinserted into the interdigitated loops. The loose flap of the batt is then reattached to the base fabric either by needling or adhesives.

While U.S. Pat. No. 4,601,785 describes a manner in which a needled pin seam base fabric can be utilized as a felt in the press section of a papermaking machine, in actual practice, after the batt is loosened, cross direction stuffers or yarns are required to be inserted beneath the flap and behind the loops to fill the gap resulting from the loosening of the batt flap from the base fabric. In addition, when installed on the papermaking machine, it is necessary that the loose flap of the batt be needled, glued, or otherwise reaffixed to the base fabric. The insertion of stuffers along with the reattachment of the flap requires a substantial amount of manual labor.

SUMMARY OF THE INVENTION

The invention is directed to an improved papermaker's felt incorporating a pin seam base fabric having a fibrous batt needled into a face of the fabric. In accordance with the invention, a pin seam fabric having interdigitated loops at the ends of the fabric joined by a pin is initially produced either in flat or endless form. A batt of fibrous material is then needled into a face of the fabric and across the pin seam joint. After needling, the pin is removed and the felt is bent back on itself at the joint to bring the portions of the batt located on either side of the joint into contiguous relation. This bending action causes the loops to separate and the batt is then cut along a line extending through the separated loops to provide a flat or opened felt.

The felt can then be installed in the press section of the papermaking machine and the pin reinserted through the interdigitated loops. On reinsertion of the pin, the cut ends of the batt fall into abutting relation to provide a uniform density for the felt at the area of the pin seam.

The method of the invention enables the batt to be cut at the pin seam joint without the danger of inadvertantly cutting or severing the base fabric. Further, it is not necessary to loosen any portion of the batt from the base fabric and thus stuffers are not required in the area of the pin seam joint to provide a uniform density for the felt in this area.

As the batt is not loosened from the base fabric it is not necessary to reattach the loosened batt to the fabric by needling or gluing as as been required in past practice.

Other objects and advantages will appear in the course of the following description.

DESCRIPTION OF THE DRAWINGS

The drawings illustrate the best mode presently contemplated of carrying out the invention.

In the drawings:

FIG. 1 is a diagrammatic cross section of the papermaker's felt of the invention;

FIG. 2 is a view similar to FIG. 1 showing the felt bent back on itself after removal of the pin from the joint;

FIG. 3 is a view similar to FIG. 1 showing the felt as assembled on the papermaking machine.

DESCRIPTION OF THE ILLUSTRATED EMBODIMENT

The drawings illustrate a papermaker's felt including a woven base fabric 1 formed of machine direction yarns 2 and cross yarns 3. The machine direction yarns 2 and cross yarns 3 can be formed of monofilaments or staple yarns and consist of synthetic or natural fibers, or mixtures thereof.

The ends of the base fabric 1 are provided with a plurality of interdigitated loops 4 which are connected by a pin or pintle 5. Base fabric 1 can be woven either in flat form and interweaving separate loops with the cross direction yarns adjacent the ends of the fabric, or alternately, the base can be woven in endless form, in which the loops are integrally formed with the fabric.

While the drawings show a base fabric formed of a single layer of machine direction and cross direction yarns, it is contemplated that the base fabric may also be composed of multiple layer fabric.

A batt of fibrous material 6 is needled into a face of the base fabric 1 in a conventional needling operation and the needling of the batt extends across the pin seam joint. The batt may be composed of synthetic or natural fibers or a mixture thereof.

After the entire length of the base fabric 1 has been needled on the needling machine, pin 5 is removed from the loops 4 and because of the needled batt 6, the felt will remain in endless form even though pin 5 has been removed. The felt is then bent back against itself at the pin seam joint, as shown in FIG. 2 to bring the portions of the batt 6 located adjacent the joint into contiguous relation. This bending action will cause the loops 4 on the ends of the fabric to separate, as shown in FIG. 2.

Batt 6 is then cut along a line through the separated loops as indicated by the blade or cutting member 7 in FIG. 2. The cut is preferably made at a slight acute angle to a plane extending through the contiguous portions of the batt Cutting of the batt enables the felt to be opened into flat form and installed in the press section of the papermaking machine. On installation in the press section, loops 4 on the ends of the felt are brought into interdigitating relation and pin 5 is reinserted through the loops, as shown in FIG. 3. As the batt 6 is not loosened from the base fabric 1, the cut ends of the batt, as indicated by 8 in FIG. 3, will automatically be brought into abutting contiguous relation to provide a uniform outer layer across the pin seam joint.

With the method of the invention, the batt is cut along a line through the separated loops 4, as shown in FIG. 2, so that there is no likelihood of the base fabric being cut or severed as the batt is cut. As a further advantage, it is not necessary to loosen a flap of the batt from the base material and correspondingly it is not necessary to reattach a loosened flap to the base fabric after the felt is installed on the papermaking machine. This substantially reduces the overall time and labor of installation on the papermaking machine.

As the batt is not separated or loosened from the base fabric in the area of the pin seam joint, there is no tendency for cross direction yarns to be pulled from the base fabric and thus there is no need to apply additional stuffers to the fabric adjacent the pin seam joint before reattaching the batt.

Various modes of carrying out the invention are contemplated as being within the scope of the following claims particularly pointing out and distinctly claiming the subject matter which is regarded as the invention.

I claim:

1. A method of making a papermaker's felt, comprising the steps of forming a pin seam fabric having interdigitated loops at the ends of the fabric joined by a pin to provide a pin seam joint, needling a batt of fibrous material onto a face of said fabric and across said joint, removing said pin from said loops, bending the fabric back on itself at said joint to bring portions of the batt located on either side of said joint into substantially contiguous relation and cause said loops to separate, cutting the batt along a line extending through the separated loops to enable said felt to be opened to a flat condition, subsequently installing the felt in a press section of a papermaking machine, and thereafter interdigitating the loops and reinserting the pin in said interdigitated loops to position the cut line in said batt in direct alignment with said pin.

2. The method of claim 1, wherein the step of forming said fabric comprises interweaving machine direction and cross direction yarns.

3. In a method of making a papermaker's felt, the steps of forming a pin seam fabric having interdigitated loops at the ends of the fabric joined by a pin to provide a pin seam joint, needling a batt of fibrous material onto a first face of said fabric, bending the fabric at said joint to bring portions of said batt located on either side of said joint into flatwise relation and cause said loops to separate into spaced relation, cutting the batt along a line through the space between said separated loops to enable said felt to be opened to a flat condition, installing the felt in a press section of a papermaking machine and interdigitating the loops, and reinserting the pin into said interdigitated loops to position the cut line in said batt in substantially direct alignment with said pin.

4. The method of claim 3, wherein said step of cutting said batt comprises cutting along a line at an actue angle with respect to a plane extending through said flatwise portions.

* * * * *